US005545075A

United States Patent [19]

Gottschald

[11] Patent Number: 5,545,075

[45] Date of Patent: Aug. 13, 1996

[54] PROCESS FOR THE PRODUCTION OF AN EDGED OPTHALMIC LENS

[75] Inventor: Lutz Gottschald, Meerbusch, Germany

[73] Assignee: Wernicke & Co., Dusseldorf, Germany

[21] Appl. No.: 170,328

[22] PCT Filed: Jul. 1, 1992

[86] PCT No.: PCT/DE92/00550

§ 371 Date: Dec. 30, 1993

§ 102(e) Date: Dec. 30, 1993

[87] PCT Pub. No.: WO93/01024

PCT Pub. Date: Jan. 21, 1994

[30] Foreign Application Priority Data

Jul. 1, 1991 [DE] Germany ..... 41 21 714.4

[51] Int. Cl.[6] ..... B24B 1/00

[52] U.S. Cl. ..... 451/42; 451/43

[58] Field of Search ..... 451/5, 8, 9, 42, 451/43

[56] References Cited

U.S. PATENT DOCUMENTS

| | | | |
|---|---|---|---|
| 1,356,330 | 8/1920 | Allen | 451/42 |
| 2,890,551 | 6/1959 | Dalton | 451/42 |
| 3,226,887 | 1/1966 | Rudd et al. | 451/42 |
| 4,203,259 | 5/1980 | Haddock | 451/5 |
| 4,573,121 | 2/1986 | Saigo et al. | 451/42 |

*Primary Examiner*—Bruce M. Kisliuk
*Assistant Examiner*—Derris H. Banks
*Attorney, Agent, or Firm*—Antonelli, Terry, Stout & Kraus

[57] ABSTRACT

Disclosed is a process for the production of an edged ophthalmic lens wherein an ophthalmic lens which initially is finished on one side and not yet edged according to a prescribed disk shape, i.e. a so-called blank having only one finished effective surface, is produced and the so-called prescription surface is produced in another manufacturing step, if need be, including optimization of the critical thickness. The invented process is distinguished by the combination of the following steps:

the prescribed disk shape is stored as a set of data, the position of the second surface (prescription surface) is computed, if need be, including the minimization of the critical thickness from the stored set of data of the prescribed disk shape and the contour of the already finished surface of said blank, subsequently the prescription surface is produced with simultaneous or previous preliminary edging of the blank according to the prescribed disk shape, following production of the prescription surface, the lens is edged, facetted and its perimeter polished in a gripping means utilizing the stored set of data.

12 Claims, No Drawings

PROCESS FOR THE PRODUCTION OF AN EDGED OPTHALMIC LENS

TECHNICAL FIELD

The present invention relates to a process for the production of an edged ophthalmic lens wherein an ophthalmic lens which initially is finished on one side but not yet edged according to a prescribed disk shape, i.e., a so-called blank having only one finished effective surface, is produced and the so-called prescription surface is produced in another manufacturing step, if need be, including the optimization of the critical thickness.

STATE OF THE ART

Presently, the production of edged ophthalmic lenses usually occurs in several largely separate manufacturing steps:

First a so-called blank is produced by an ophthalmic lens manufacturer. This usually refers to a "raw-round" ophthalmic lens finished on one side. In certain cases, however, the contour of the perimeter of a blank may deviate from the circular shape: therefore it has been proposed to fabricate ellipsoidal-shaped blanks.

The finished, processed surface, sometimes also referred to as the effective surface, is usually the "more difficult-to-produce" surface, i.e. in a progressive ophthalmic lens, the progressive surface or in the case of a toric ophthalmic lens, the toric surface. Following the production of the effective surface, in many cases the blank is "stored intermediately" in a stockroom "near the customer". The second surface, also referred to as the prescription surface and usually a "simple", spherical or toric surface, is not produced until it is specifically ordered. Production of the prescription surface, which often is carried out "near the customer", i.e. decentrally in so-called prescription lens production workshops, usually occurs without taking into consideration the shape of the spectacles into which the ophthalmic lens is to be inserted.

But rather the edges of the ophthalmic lens are processed by the respective optician selling the spectacles to the customer. Only then, when the critical thickness of the ophthalmic lens, i.e. the center thickness in plus lenses, respectively the edge thickness in minus lenses, are to be minimized, "preliminary edging" of the ophthalmic lens, respectively the blank, occurs in conjunction with the production of the prescription surface according to the processes described in the patent literature. With regard to this, reference is made, by way of example, to DE 38 01 384 A1 and the literature cited therein.

These currently practised procedures for producing edged ophthalmic lenses require that a series of steps be executed several times:

By way of illustration, if the lens is to undergo preliminary edging, a necessary production step be it in the prescription lens production workshop or at the optician's, the disk shape of the spectacles has to be determined as a set of data.

Moreover, it is necessary both in the prescription production workshops and at the optician's to hold the lens for processing, i.e. to grip it in such a manner that the lens can be inserted in the respective processing apparatus.

Repeated execution of the same procedures is not only time and therefore cost consuming but also a major source of errors.

DESCRIPTION OF THE INVENTION

The object of the present invention is to provide a process for the production of an edged ophthalmic lens wherein an ophthalmic lens which is initially finished on one side but not yet edged according to a prescribed disk shape, i.e. a so-called blank having only one finished effective surface, is produced wherein the multiple execution of various steps, such as determination and storage of the disk shape of the spectacle frame, are avoided.

A solution to this object according to the present invention is set forth in claim 1. Further improvements of the present invention are characterized in claim 2 and those following.

The present invention is based on the fundamental idea of carrying out the production of the prescription surface and edge processing with an once only determined and stored set of data for the disk shape without renewed gripping of the ophthalmic lens.

For this purpose, the prescribed disk shape is stored as a set of data, by way of illustration as a function $r=r(\Phi)$. (claim 2). The once only determination of the set of data may occur in any desired manner: by way of illustration a so-called tracer may be employed which scans the spectacle frame and in this way ascertains the function $r=r(\Phi)$. Furthermore, it is naturally possible to generate the set of data directly from the manufacturer's production data.

From the stored set of data, the prescribed disk shape and the contour of the already finished surface of the blank as well as the so-called grinding data (seeing-through point, etc.), the position of the second surface (prescription surface), if need be, including minimization of the critical thickness can be computed.

From these data, the prescription surface is produced with simultaneous or previous preliminary edging of the blank (claim 12) according to the prescribed disk shape. The "preliminary edging" occurs, in particular, if the processing apparatus is utilized both for processing the surface and processing the edge, preferably prior to or at least simultaneously with the surface processing as in this way processing time is minimized and the milling and polishing process is improved.

Following the production of the prescription surface, the lens undergoes final edging, facetting and polishing of the perimeter utilizing the stored set of data.

The present invention thus permits production of a finished ophthalmic lens in a short time with the exclusion of previously present sources of errors.

All the procedures can, preferably, be utilized in a single processing apparatus, by way of illustration a milling apparatus (claim 4), with largely conventional commercial milling tools, like those employed for processing surfaces, and executed, in particular, without "gripping" the blank.

Furthermore, a revolving apparatus (claim 3), in which movement between the rotating bit and the revolving support holding the ophthalmic lens during the edge processing is controlled by means of the data $r=r(\Phi)$ describing the disk shape, may also be employed as the processing apparatus for the edge as well as the prescription surface. The use of such a revolving apparatus permits especially quick processing.

In any event, i.e. even if different processing apparatuses are employed for the edge-and the surface (claim 5) it is, however, preferable if the lens is picked up following the production of the effective surface by a holding means (block) which remains on the effective surface during the further course of the production process.

Attaching the block occurs preferably by the manufacturer of the blank, as is described in DE 40 03 002 A1, to which moreover explicitly reference is made with regard to the possible improvement of a block utilized both for surface as well as edge processing.

This support, which by way of illustration may be attached on the effective surface with adhesive rings or the like (claim 6), is preferably a disposable block which is processed along as well during preliminary edging and/or the production of the prescription surface or is reduced in size as set forth in DE 40 03 002 A1.

In other words, a block which (initially) is so large that is supports the lens, respectively the blank, over a large area is placed on the already finished "effective surface" during the production of the prescription surface. During edge processing (or even during "preliminary edging"), the processing tool, thus by way of illustration the milling tool or the revolving bit, also reduces the size of the block in such a manner that the contour of its perimeter approximately corresponds to the perimeter of the edged ophthalmic lens (claim 7). This method of operation has the advantage that the ophthalmic lens is always optimumly supported during the processing.

In the invented process, the blank can, according to claim 8, be actively or passively, held decentered as is known from the state of the art for edge processing but not for surface processing. Taking decentering into account is readily possible for surface processing by means of numerically controlled processing apparatuses.

Especially advantageous is in any case if, according to claim 9, the variation of the thickness of the disk shape is stored as a function $z=z(0)$ and, according to claim 10, the production of the facet is controlled by the function $z=z\ (0)$ and occurs in such a manner that the facet is in a prescribed relationship to the two surfaces of the edged ophthalmic lens.

As a result there is no "unsightly" projection of lenses having great edge thickness (minus lenses) beyond the frame as would be yielded with a so-called free-running facet.

This measure can, if need be, be utilized independently of the aforementioned measures.

The other stored sets of data $z(\Phi)$ can also be employed for surface processing as well as for edge processing.

Furthermore, deburring and/or fine processing of the edge can be carried out utilizing the stored sets of data (claim 11).

On the basis of the preceding description, someone versed in the art working in the field can readily realize the invented process with the means known to him, i.e. using numerically controlled apparatuses for edge and/or surface processing.

Using a single apparatus for carrying out all the processing procedures is also known, respectively described in older applications of the same applicant.

Furthermore, generation of the sets of data $r=r(\Phi)$ and $z=z(\Phi)$ is common knowledge.

For this reason the description of a drawn illustration of a preferred embodiment is obviated.

INDUSTRIAL APPLICATION

The present invention can be utilized for the production of ophthalmic lenses both by the manufacturers of "blanks" as well as in so-called grinding workshops or at the optician's.

What is claimed is:

1. A process for the production of an edged ophthalmic lens wherein an ophthalmic lens which initially is finished on one side and not yet edged according to a prescribed disk shape, i.e., a so-called blank having only one finished effective surface, is produced and the so-called prescription surface is produced in another manufacturing step, comprising calculating a position of the prescription surface in relation to the finished effective surface from the prescribed disk shape stored as a set of data, from a stored set of data of the prescription surface and from a contour of the finished effective surface;

producing the prescription surface and at least preliminarily edging the blank, without renewed gripping of the blank, in a single processing apparatus utilizing the calculated data; and final edging, facetting and polishing a perimeter of the blank utilizing the calculated data, wherein said lens is held by a block following production of said effective surface, said block remaining on said effective surface during the further course of the production operation.

2. A process according to claim 1, characterized by said prescribed disk shape being stored as a function $r=r(\Phi)$.

3. A process according to claim 2, characterized by a revolving apparatus in which movement between a rotating bit and a revolving support holding the ophthalmic lens is controlled during edge processing by means of the disk-shape-specifying data $r=r(\Phi)$ being employed as said processing apparatus.

4. A process according to claim 1, characterized by a milling apparatus being employed as said processing apparatus.

5. A process according to claim 1, characterized by separate processing apparatuses being employed for said final edging and for producing said prescription surface.

6. A process according to claim 1, characterized by said block being attached to said effective surface by means of adhesive rings.

7. A process according to claim 1, characterized by said block being a disposable block which is processed as well during said preliminary edging and/or said production of said prescription surface.

8. A process according to claim 1 or 2, characterized by said blank being actively or passively decentrally held.

9. A process according to claim 1, charaterized by the variation in thickness of said disk shape being stored as a function $z=Z(\Phi)$ and the facet position being determined therefrom.

10. A process according to claim 9, characterized by the production of the facet occurring by being controlled by said function $z=z(\Phi)$ in such a manner that said facet is in a prescribed relationship to both surfaces of the edged ophthalmic lens.

11. A process according to claim 1, characterized by the deburring and/or fine processing of the edge occurring with the use of said stored sets of data.

12. A process according to claim 1, characterized by said blank being preliminary edged prior to said production of said prescription surface.

* * * * *